US006248970B1

(12) United States Patent
DiMarco et al.

(10) Patent No.: US 6,248,970 B1
(45) **Date of Patent: *Jun. 19, 2001**

(54) ARC CHUTE FOR A MOLDED CASE CIRCUIT BREAKER

(75) Inventors: Bernard DiMarco, Lilburn; Neal B. Reeves, Atlanta; Mark Blankemeyer, Suwanee, all of GA (US)

(73) Assignee: Siemens Energy & Automation, Inc., Alpharetta, GA (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/435,305

(22) Filed: Nov. 5, 1999

(51) Int. Cl.[7] ..... H01H 9/30

(52) U.S. Cl. ..... 218/149; 218/15; 218/151; 218/156

(58) Field of Search ..... 335/201; 218/15, 218/27, 34, 35, 36, 37, 76, 77, 81, 89, 90, 103, 105, 106, 149, 151, 155, 156, 157; 300/293–308

(56) References Cited

U.S. PATENT DOCUMENTS

| | | | | |
|---|---|---|---|---|
| 2,644,048 | * | 6/1953 | Frink et al. | 218/154 |
| 3,440,378 | * | 4/1969 | Baird | 335/201 |
| 3,784,775 | * | 1/1974 | Gryctko et al. | 218/156 |
| 3,997,746 | * | 12/1976 | Harper et al. | 218/157 |
| 4,217,472 | * | 8/1980 | Gryctko et al. | 218/157 |
| 4,370,634 | | 1/1983 | Kondo et al. . | |
| 4,375,021 | | 2/1983 | Pardini et al. . | |
| 4,480,161 | * | 10/1984 | Kellogg et al. | 218/156 |
| 4,689,546 | | 8/1987 | Stephens et al. | 322/99 |
| 4,737,606 | | 4/1988 | Winter . | |
| 4,877,929 | * | 10/1989 | Rival | 218/156 |
| 4,950,852 | | 8/1990 | Goldman et al. . | |
| 4,973,805 | | 11/1990 | Paton . | |
| 4,975,553 | | 12/1990 | Oster . | |
| 5,004,874 | | 4/1991 | Theisen et al. . | |
| 5,130,504 | | 7/1992 | Moldovan et al. . | |
| 5,569,894 | * | 10/1996 | Uchida et al. | 218/27 |
| 5,834,724 | * | 11/1998 | Asakawa et al. | 218/36 |
| 5,877,467 | | 3/1999 | Arnold et al. | 218/148 |

* cited by examiner

*Primary Examiner*—Lincoln Donovan
*Assistant Examiner*—Tuyen T. Nguyen
(74) *Attorney, Agent, or Firm*—Foley & Lardner

(57) ABSTRACT

A circuit breaker (10) including an electrical arc extinguishing apparatus (105). The electric arc extinguishing arc apparatus (105) includes a first sidewall (106) in a spaced relationship with the second sidewall (107) with a top arc plate (110) mounted between the first and second sidewalls (106, 107). A plurality of intermediate arc plates (114) are mounted between the first (106) and second sidewalls (107) below the top arc plate (110) with each in a spaced apart relationship. A bottom arc plate (116) is mounted between the first and second sidewalls below and apart from the intermediate plates (114) forming an arc chute. The electric arc extinguishing apparatus (105) can also be provided with two end caps (120) with each end cap (120) having an interior cavity (121) with one leg (111) of each arc plate (58) mounted in the cavity (121) of one end cap (120) and the other leg (111) of each arc plate (58) mounted in the cavity (121) of the other end cap (120).

15 Claims, 7 Drawing Sheets

FIG. 5
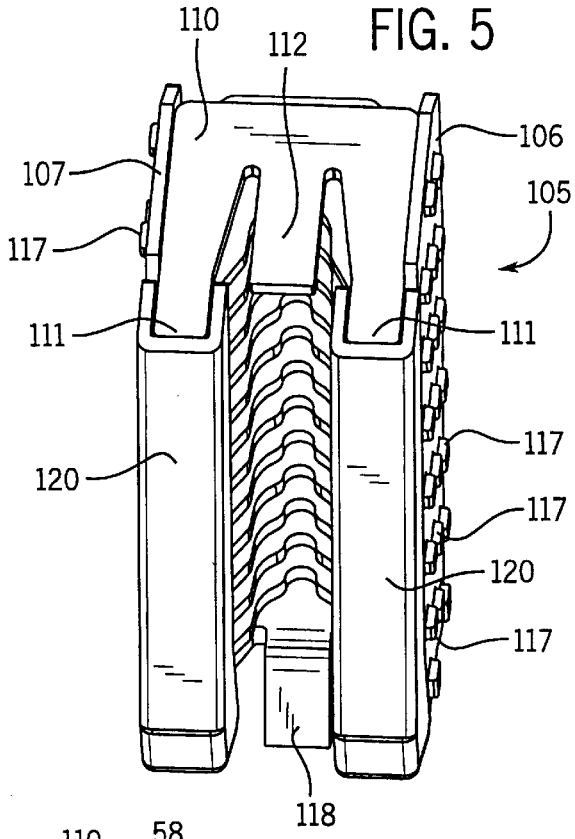
FIG. 6
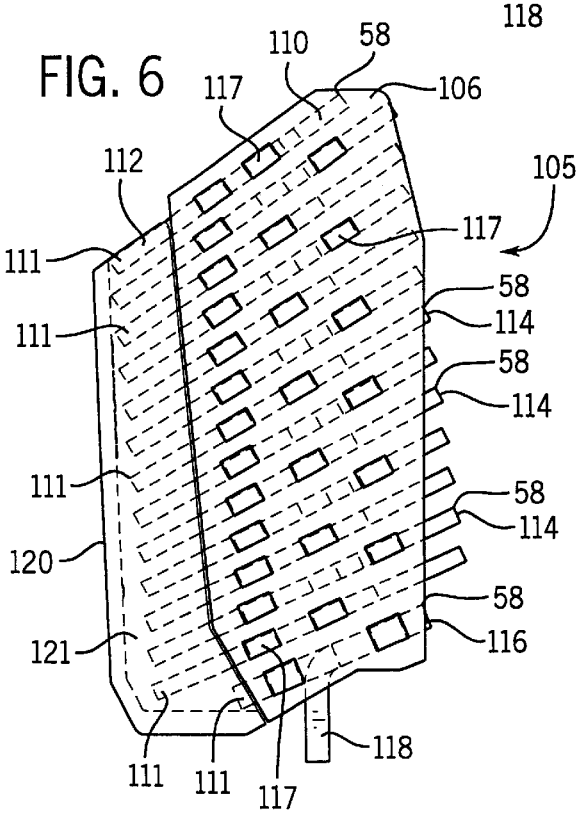
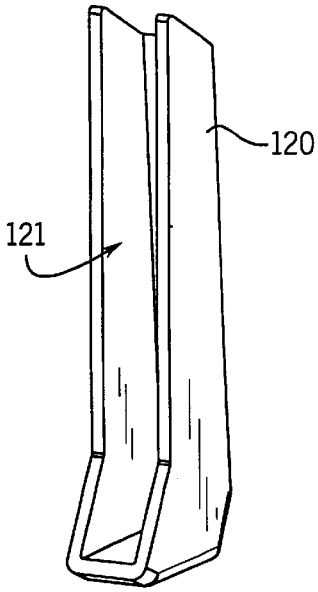
FIG. 7

ARC CHUTE FOR A MOLDED CASE CIRCUIT BREAKER

FIELD OF THE INVENTION

The present invention relates generally to the field of circuit breakers, and more particularly to a molded case circuit breaker arc chute.

BACKGROUND OF THE INVENTION

In general the function of a circuit breaker is to electrically engage and disengage a selected circuit from an electrical power supply. This function occurs by engaging and disengaging a pair of operating contacts for each phase of the circuit breaker. The circuit breaker provides protection against persistent overcurrent conditions and against the very high currents produced by short circuits. Typically, one of each pair of the operating contacts are supported by a pivoting contact arm while the other operating contact is substantially stationary. The contact arm is pivoted by an operating mechanism such that the movable contact supported by the contact arm can be engaged and disengaged from the stationary contact.

There are two modes by which the operating mechanism for the circuit breaker can disengage the operating contacts: the circuit breaker operating handle can be used to activate the operating mechanism; or a tripping mechanism, responsive to unacceptable levels of current carried by the circuit breaker, can be used to activate the operating mechanism. For many circuit breakers, the operating handle is coupled to the operating mechanism such that when the tripping mechanism activates the operating mechanism to separate the contacts, the operating handle moves to a fault or tripped position.

To engage the operating contacts of the circuit breaker, the circuit breaker operating handle is used to activate the operating mechanism such that the movable contact s) engage the stationary contact s). A motor coupled to the circuit breaker operating handle can also be used to engage or disengage the operating contacts. The motor can be remotely operated.

A typical industrial circuit breaker will have a continuous current rating ranging from as low as 15 amps to as high as 160 amps. The tripping mechanism for the breaker usually consists of a thermal overload release and a magnetic short circuit release. The thermal overload release operates by means of a bi-metalic element, in which current flowing through the conducting path of a circuit breaker generates heat in the bi-metal element, which causes the bi-metal to deflect and trip the breaker. The heat generated in the bi-metal is a function of the amount of current flowing through the bi-metal as well as for the period of time that that current is flowing. For a given range of current ratings, the bi-metal cross- section and related elements are specifically selected for such current range resulting in a number of different circuit breakers for each current range.

In the event of current levels above the normal operating level of the thermal overload release, it is desirable to trip the breaker without any intentional delay, as in the case of a short circuit in the protected circuit, therefore, an electromagnetic trip element is generally used. In a short circuit condition, the higher amount of current flowing through the circuit breaker activates a magnetic release which trips the breaker in a much faster time than occurs with the bi-metal heating. To limit the duration and the intensity of short circuit currents, the circuit breaker must, within the shortest possible time, separate its contacts and extinguish the resulting electric arcs. The circuit breaker must operate to shorten both the time of intervention, i.e., commence movement of the contacts away from each other and the time of extinction of the arc by increasing arc voltage. The known manner to extinguish the arc is to extend it and cool it. Prior art methods have included puffing air or a gas into the arc chamber while the contacts of the circuit breaker move apart. Another solution has been to install a magnetic motor which forces the arc in a selected direction typically into a stacked array of arc baffels. A further solution has been to increase the number of baffels in the stacked array and insert insulating elements between the arc baffels to promote a series of small arcs thereby contributing to the increase in the arc voltage and ultimate extinguishment of the arc. All of these methods or apparatus of arc extinction involve additional parts adding to the manufacturing and maintenance costs of the circuit breaker as well as to the complexity of the circuit breaker.

Thus, there is a need for an arc extinguishing apparatus or arc chute that will extend and cool the electric arc formed during separation of circuit breaker contacts, while under load, without pneumatic or electro magnetic elements. There is a further need to provide an arc extinguishing apparatus with a minimum of unique elements. There is also a need for an arc extinguishing apparatus that can be used with several types of circuit breakers, such as circuit breakers with a single moveable contact element, with two moveable contacts as well as with single and multiple pole circuit breakers.

SUMMARY OF THE INVENTION

The circuit breaker of the present invention includes an electrical arc extinguishing apparatus. The electric arc extinguishing apparatus includes a first sidewall in a spaced relationship with the second sidewall with a top arc plate mounted between the first and second sidewalls. A plurality of intermediate arc plates are mounted between the first and second sidewalls below the top arc plate with each in a spaced apart relationship. A bottom arc plate is mounted between the first and second sidewalls below and apart from the intermediate plates forming an arc chute. One embodiment of the electric arc extinguishing apparatus includes a top arc plate having an arc runner extending into the arc chute. Another embodiment includes a bottom arc plate that has an arc runner extending into the arc chute. A further embodiment includes an arc runner extending into the arc chute from both the top arc plate and the bottom arc plate. The electric arc extinguishing apparatus can also be provided with two end caps with each end cap having an interior cavity with one leg above each arc plate mounted in the cavity of one end cap and the other leg of each arc plate mounted in the cavity of the other end cap. During a short circuit condition operation of the circuit breaker, the end caps expel a gas which assists in extinguishing the arc generated between the contacts of the circuit breaker. The circuit breaker also includes a first terminal and a second terminal mounted in the molded case of the circuit breaker. The first contact is electrically coupled to the first terminal and the second contact is electrically coupled to the second terminal. An operating mechanism having an ON position, an OFF position and a TRIPPED position is coupled to the second contact. An intermediate latching mechanism is mounted in the housing and is coupled to the operating mechanism. The trip unit coupled to the second contact and the second terminal is selectively operative with the intermediate latching mechanism.

BRIEF DESCRIPTION OF THE DRAWINGS

FIG. 5 is an isometric view of an embodiment of an arc chute assembly.

FIG. 6 is a side view of the arc chute assembly of FIG. 5 illustrating the disposition of the arc plates mounted on a sidewall with the legs of each arc plate in the cavity of an end cap.

FIG. 7 is an isometric view of a molded end cap, viewed into the cavity.

DETAILED DESCRIPTION OF THE PREFERRED EMBODIMENTS

Figure 1:
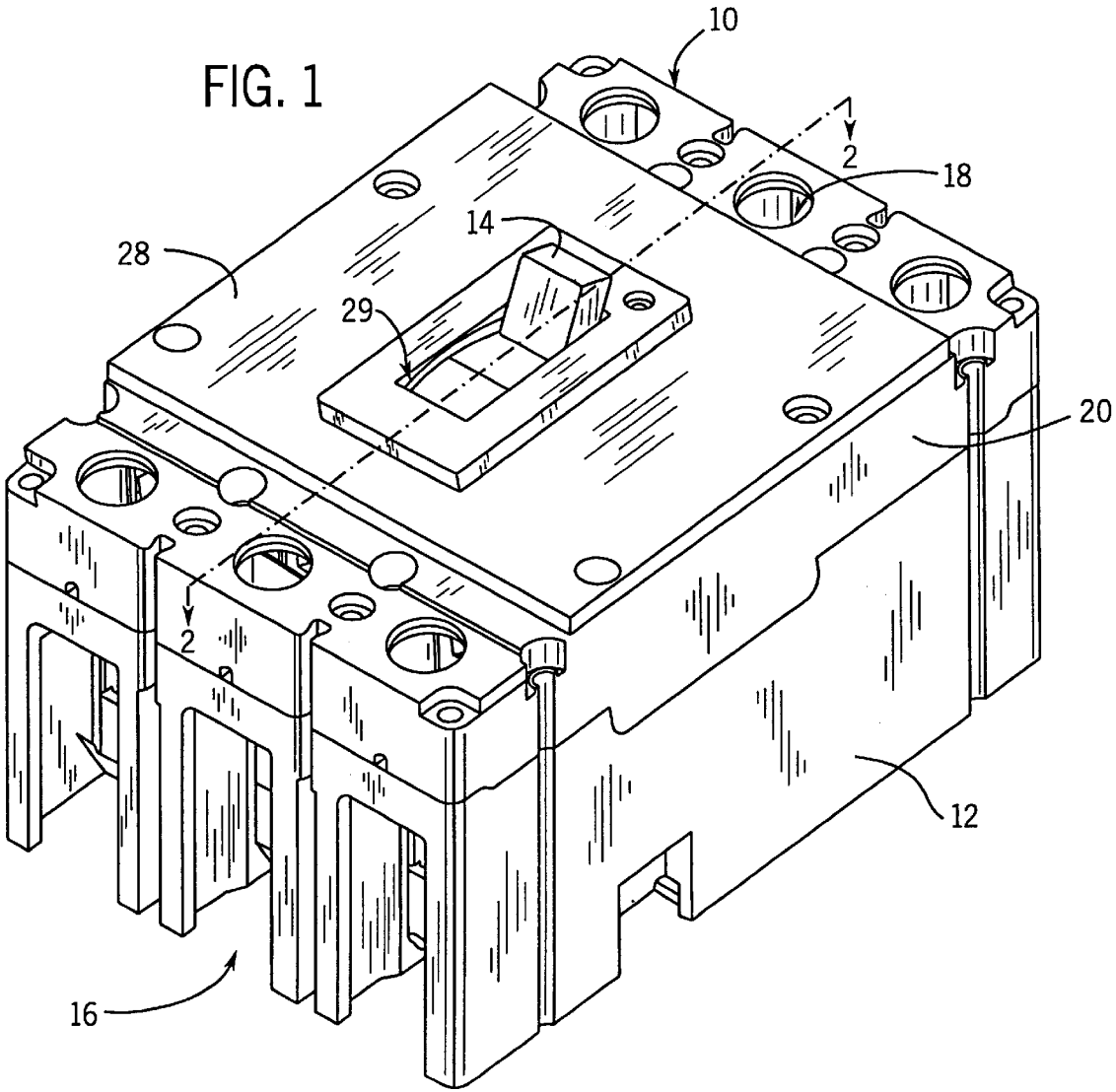
FIG. 1 is an isometric drawing of a molded case circuit breaker which includes an embodiment of the present arc chute.

FIG. 1 generally illustrates a three phase molded case circuit breaker 10 of the type which includes an operating mechanism 40 having a pivoting member 13 with a handle 14. The pivoting member 13 and handle 14 are moveable between an ON position, an OFF position and a TRIPPED position.

The exemplary circuit breaker 10 is a three pole breaker having three sets of contacts for interrupting current in each of the three respective electrical transmission phases. In the exemplary embodiment of the invention, each phase includes separate breaker contacts and a separate trip mechanism. The center pole circuit breaker includes an operating mechanism which controls the switching of all three poles of the breaker. Although an embodiment of the present invention is described in the context of the three phase circuit breaker, it is contemplated that it may be practiced in a single phase circuit breaker or in other multi-phase circuit breakers.

Figure 2:
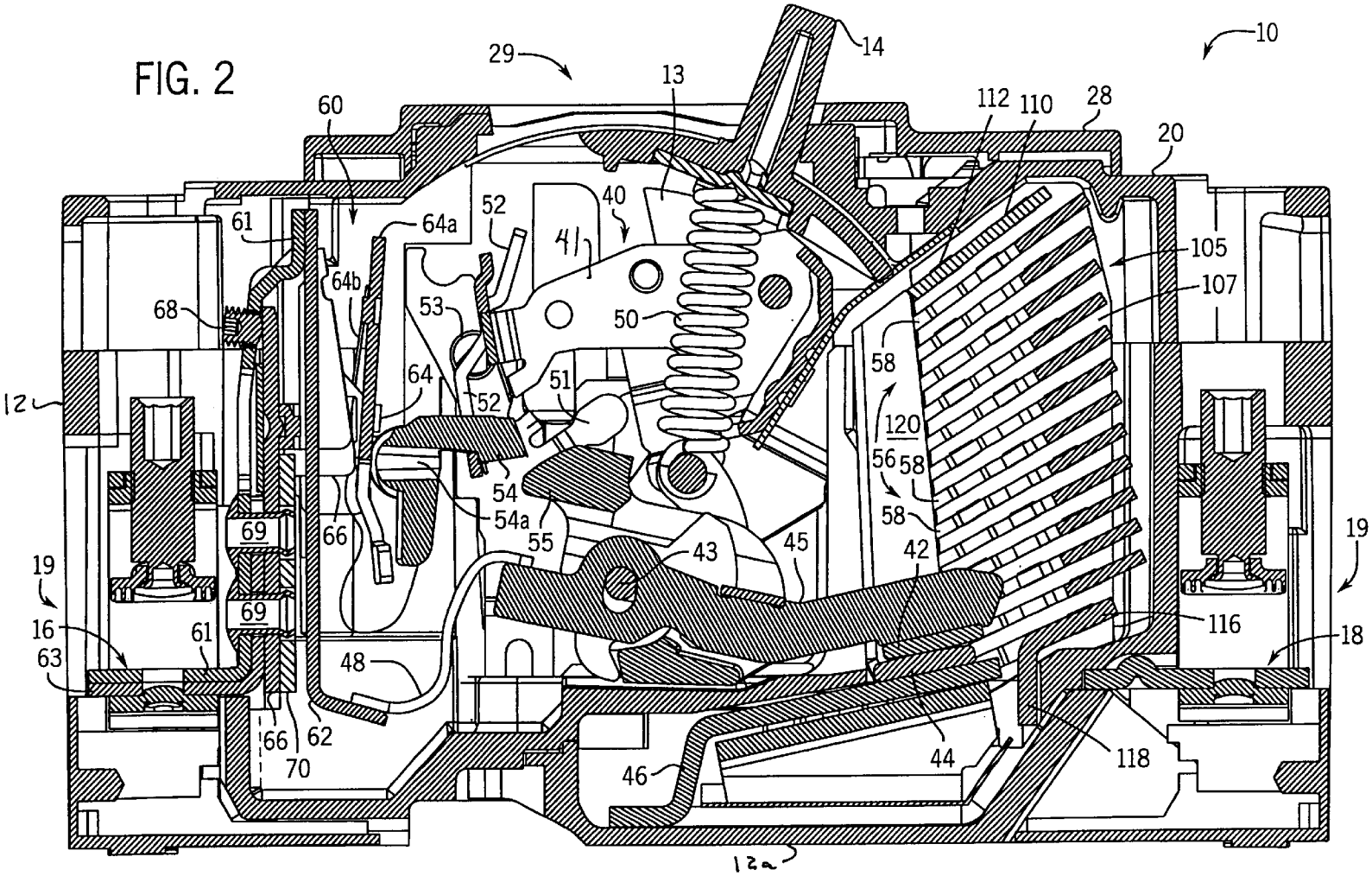
FIG. 2 is a section view of the circuit breaker shown in FIG. 1 along the lines 2—2 and is used to describe the operation of the circuit breaker.

Referring to FIG. 2., handle 14 is operable between the ON and OFF positions to enable a contact operating mechanism 40 to engage and disengage a moveable contact 42 and a stationary contact 44 for each of the three phases, such that the line terminal 18 and load terminal 16 of each phase can be electrically connected. The circuit breaker housing 12 includes three portions which are molded from an insulating material. These portions include a circuit breaker base 12, a circuit breaker cover 20 and an accessory cover 28 with breaker cover 20 and the accessory cover 28 having an opening 29 for the handle 14 of the pivoting member 13. The pivoting member 13 and handle 14 move within the opening 29 during the several operations of the circuit breaker 10. FIG. 2 is a cut away view of the circuit breaker 10 along the lines 2—2 shown in FIG. 1. As shown in FIG. 2, the main components of the circuit breaker are a fixed line contact arm 46 and a moveable load contact arm 45. It should be noted that another embodiment of the circuit breaker 10 has a movable line contact arm to facilitate a faster current interruption action. The load contact arms for each of the three phases of the exemplary breaker are mechanically connected together by an insulating cross bar member 55. This cross bar member 55, in turn, is mechanically coupled to the operating mechanism 40 so that, by moving the handle 14 from left to right, the cross bar 55 rotates in a clockwise direction and all three load contact arms 45 are concurrently moved to engage their corresponding line contact arms 46, thereby making electrical contact between moveable contact pad 42 and stationary contact pad 44.

The operating mechanism 40 includes a cradle 41 which engages an intermediate latch 52 to hold the contacts of the circuit breaker in a closed position unless and until an over current condition occurs, which causes the circuit breaker to trip. A portion of the moveable contact arm 45 and the stationary contact bus 46 are contained in an arc chamber 56. Each pole of the circuit breaker 10 is provided with an arc chamber 56 which is molded from an insulating material and is part of the circuit breaker 10 housing 12. A plurality of arc plates 58 are maintained in the arc chamber 56. The arc plates facilitate the extension and cooling of the arc formed when the circuit breaker 10 is opened while under aload and drawing current. The arc chamber 56 and arc plates 58 direct the arc away from the operating mechanism 40. The arc chamber 56 and arc plates 58 that make up an arc chute assembly 105 will be more fully described below.

The exemplary intermediate latch 52 is generally Z-shaped having an upper leg which includes a latch surface that engages the cradle 41 and a lower leg having a latch surface which engages a trip bar 54. The center portion of the Z-shaped intermediate latch element 52 is angled with respect to the upper and lower legs and includes two tabs which provide a pivot edge for the intermediate latch 52 when it is inserted into the mechanical frame 51. As shown in FIG. 2, the intermediate latch 52 is coupled to a torsion spring 53 which is retained in the mechanical frame 51 by the mounting tabs of the intermediate latch 52. The torsion spring 53 biases the upper latch surface of the intermediate latch 52 toward the cradle 41 while at the same time biasing the trip bar 54 into a position which engages the lower latch surface of the intermediate latch 52. The trip bar 54 pivots in a counter clockwise direction about an axis 54*a*, responsive to a force exerted by a bi-metalic element 62, during, for example, a long duration over current condition. As the trip bar 54 rotates, in a counter clockwise direction, the latch surface on the upper portion of the trip bar disengages the latch surface on the lower portion of the intermediate latch 52. When this latch surface of the intermediate latch 52 is disengaged, the intermediate latch 52 rotates in a counter clockwise direction under the force of the operating mechanism 40, exerted through a cradle 41. In the exemplary circuit breaker, this force is provided by a tension spring 50. Tension is applied to the spring when the breaker toggle handle 14 is moved from the open position to the closed position. More than one tension spring 50 may be utilized.

As the intermediate latch 52 rotates responsive to the upward force exerted by the cradle 41, it releases the latch on the operating mechanism 40, allowing the cradle 41 to rotate in a clockwise direction. When the cradle 41 rotates, the operating mechanism 40 is released and the cross bar 55 rotates in a counter clockwise direction to move the load contact arms 45 away from the line contact arms 46.

During normal operation of the circuit breaker, current flows from the line terminal 18 through the line contact arm 46 and its stationary contact pad 44 to the load contact arm 45 through its contact pad 42. From the load contact arm 45, the current flows through a flexible braid 48 to the bi-metalic element 62 and from the bi-metalic element 62 to the load terminal 16. (See FIG. 3) When the current flowing through the circuit breaker exceeds the rated current for the breaker, it heats the bi-metalic element 62, causing the element 62 to bend towards the trip bar 54. If the over current condition persists, the bi-metalic element 62 bends sufficiently to engage the trip bar surface. As the bi-metalic element engages the trip bar surface and continues to bend, it causes the trip bar 54 to rotate in a counter clockwise direction releasing the intermediate latch 52 and thus unlatching the operating mechanism 40 of the circuit breaker.

Figure 3:
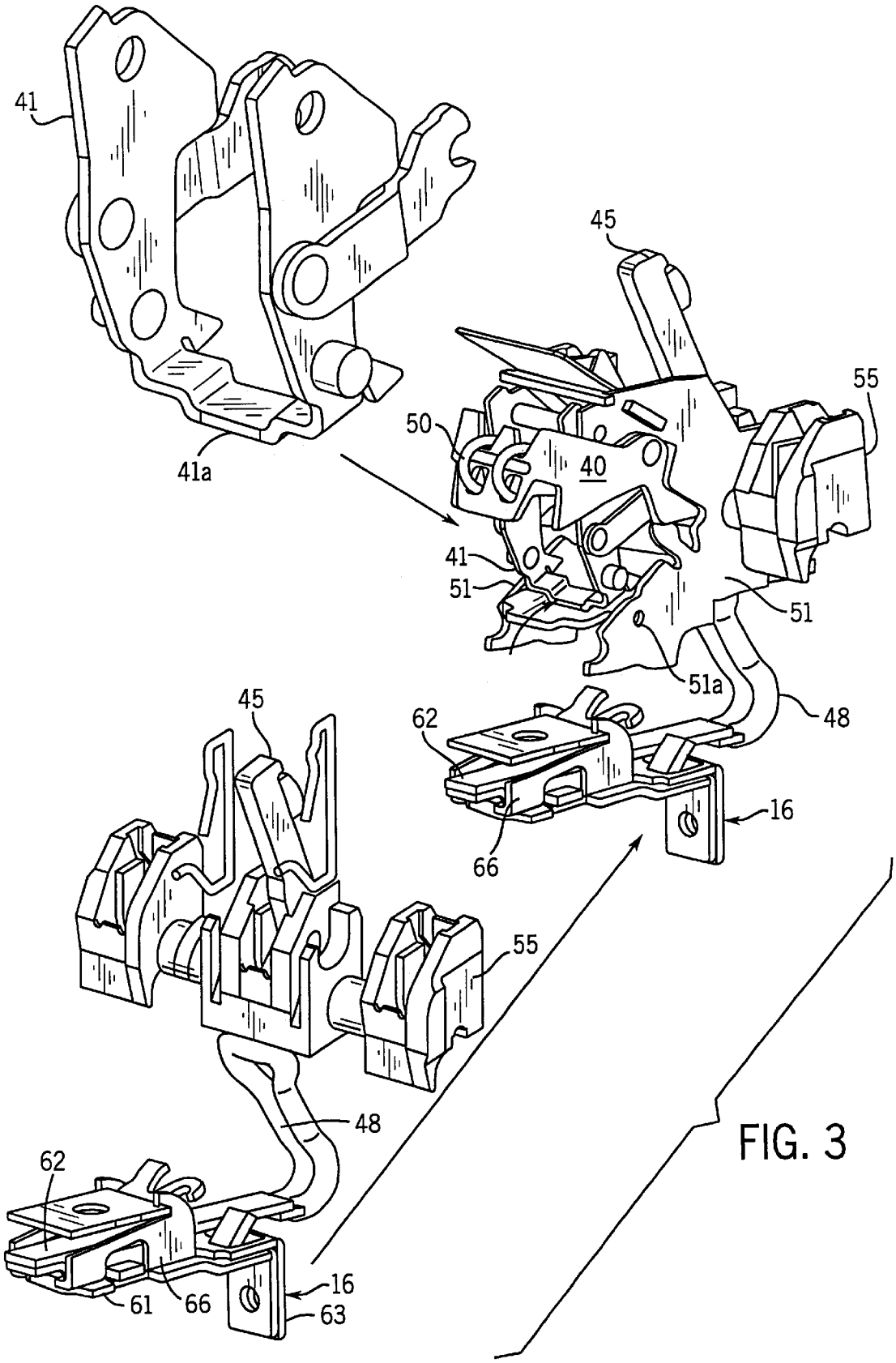
FIG. 3 is an exploded isometric drawing of the operating mechanism, contact structure and bi-metal trip unit of the circuit breaker shown in FIG. 1.

FIG. 3 is an exploded isometric drawing which illustrates the construction of a portion of the circuit breaker shown in FIG. 2. In FIG. 3 only the load contact arm 45 of the center pole of the circuit breaker is shown. This load contact arm 45 as well as the contact arms for the other two poles, are fixed in position in the cross bar element 55. As mentioned above, additional poles, such as a four pole molded case circuit breaker can utilize the same construction as described herein, with the fourth pole allocated to a neutral. The load contact arm 45 is coupled to the bi-metalic element 62 by a flexible conductor 48 (e.g. braided copper strand). As shown in FIG. 3, current flows from the flexible conductor 48 through the bi-metalic element 62 to a connection at the top of the bi-metalic element 62 which couples the current to the load terminal 16 through the load bus 61. The load bus 61 is supported by a load bus support 63. It should be noted that more than one flexible conductor 48 may be utilized.

In the exemplary circuit breaker 10, the cross bar 55 is coupled to the operating mechanism 40, which is held in place in the base or housing 12 of the molded case circuit breaker 10 by a mechanical frame 51. The key element of the operating mechanism 40 is the cradle 41. As shown in FIG. 3, the cradle 41 includes a latch surface 41*a* which engages the upper latch surface in the intermediate latch 52. The intermediate latch 52 is held in place by its mounting tabs which extend through the respective openings 51a on either side of the mechanical frame 51. In the exemplary embodiment of the circuit breaker, the two side members of the mechanical frame 51 support the operating mechanism 40 of the circuit breaker 10 and retain the operating mechanism 40 in the base 12 of the circuit breaker 10.

Figure 4:
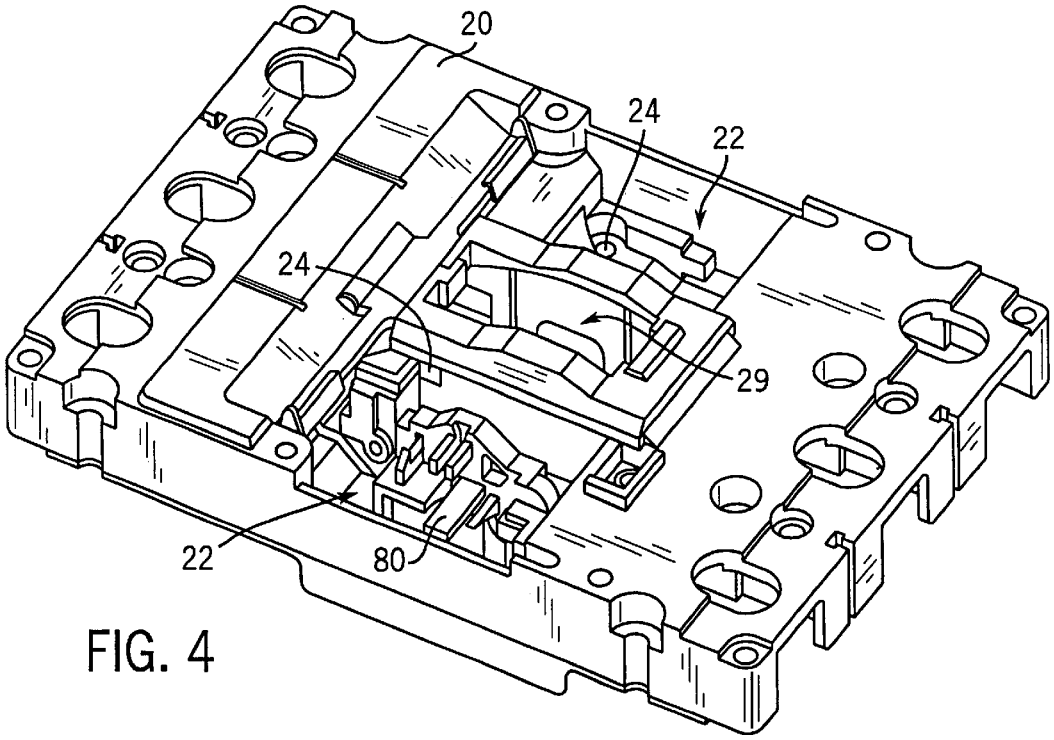
FIG. 4 is an illustration of the circuit breaker cover for the circuit breaker shown in FIG. 1.

FIG. 4 illustrates the breaker cover 20. The breaker cover 20, in the preferred embodiment, has two accessory sockets 22 formed in the cover 20, with one accessory socket 22 on either side of the opening 29 for the pivoting member 13 and handle 14. The breaker cover 20 with the accessory sockets 22 or compartments can be formed, usually by well known molding techniques, as an integral unit. The accessory socket 22 can also be fabricated separately and attached to the breaker cover 20 by any suitable method such as with fasteners or adhesives. The breaker cover 20 is sized to cover the operating mechanism 40, the moveable contact 42 and the stationary contact 44, as well as the trip mechanism 60 of the circuit breaker 10. The breaker cover has an opening 29 to accommodate the handle 14.

Each accessory socket or compartment 22 is provided with a plurality of openings 24. The accessory socket openings 24 are positioned in the socket 22 to facilitate coupling of an accessory 80 with the operating mechanism 40 mounted in the housing 12. The accessory socket openings 24 also facilitate simultaneous coupling of an accessory 80 with different parts of the operating mechanism 40. Various accessories 80 can be mounted in the accessory compartment 22 to perform various functions. Some accessories, such as a shunt trip, will trip the circuit breaker 10, upon receiving a remote signal, by pushing the trip bar 54 in a counter clockwise direction causing release of the mechanism latch 52 of the operating mechanism 40 via the trip bar 54. The shunt trip has a member protruding through one of the openings in the accessory socket 22 and engages the operating mechanism 40. Another accessory, such as an auxiliary switch, provides a signal indicating the status of the circuit breaker 10, e.g. "on" or "off". When the auxiliary switch is nested in the accessory socket 22, a member on the switch assembly protrudes through one of the openings 24 in the socket 22 and is in engagement with the operating mechanism 40, typically the cross bar 55. Multiple switches can be nested in one accessory socket 22 and each switch can engage the operating mechanism through a different opening 24 in the socket 22.

During operation of the circuit breaker 10, that is to say when the two contacts 42, 44 separate while under load, an electrical arc is drawn between the two contacts 42, 44 as they move apart. During such arcing, the material of which the contacts 42, 44 are constructed tend to pit and vaporize while the arc is sustained between the two contacts. Such action shortens the useful life of the circuit breaker 10. The present embodiment of the arc chute assembly 105 facilitates the transfer of the electric arc from the contacts to the arc chute assembly 105.

The arc chute assembly 105 is best seen by referring to FIGS. 5 through 10 wherein the first sidewall 106 and a second sidewall 107 are in a spaced apart relationship where between a plurality of arc plates 58 are mounted. The top arc plate 110 is mounted between the first and second sidewall 106, 107 then a plurality of intermediate arc plates 114 are mounted between the first and second sidewall 106, 107 below the top arc plate 110 in a spaced apart relationship and a bottom arc plate 116 is mounted between the first and second sidewalls, 106, 107 below and apart from the intermediate plates 114 forming an arc chute 105.

Figure 8:
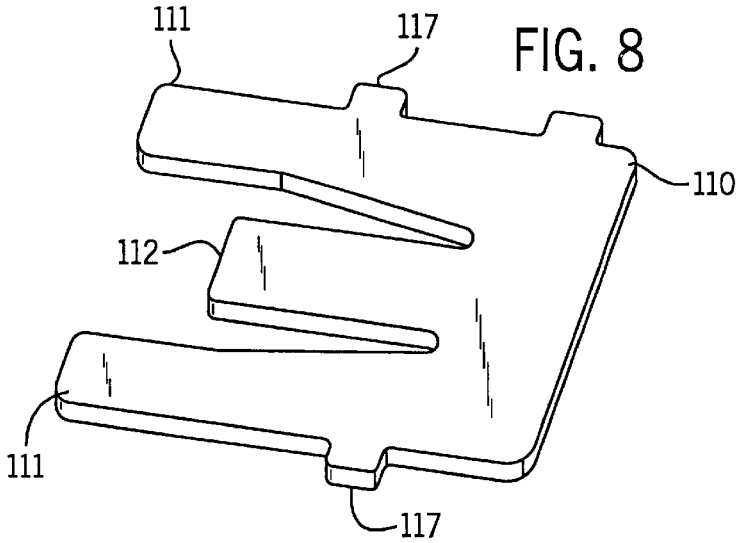
FIG. 8 is a perspective view of a top arc plate with an integral arc runner.
Figure 9:
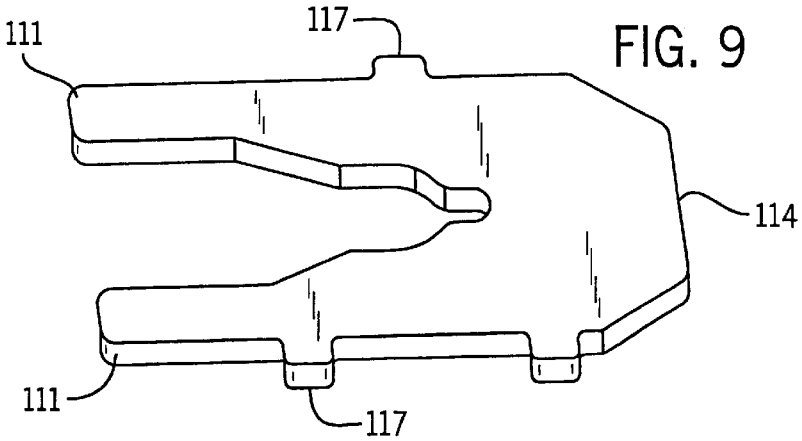
FIG. 9 is a perspective view of a U-shaped intermediate arc plate.
Figure 10:
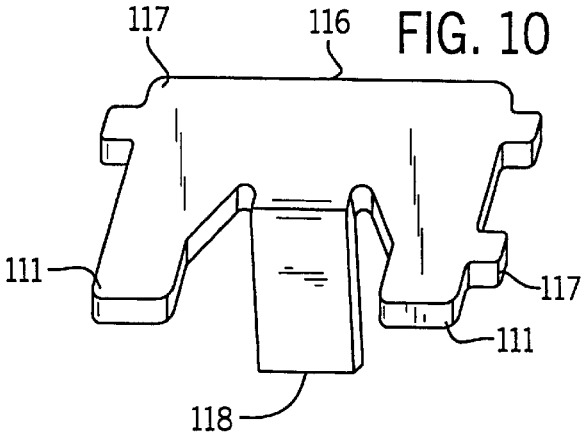
FIG. 10 is a perspective view of a bottom arc plate with an integral arc runner.

An embodiment of the present arc chute assembly 105 provides an arc runner 112 on the top arc plate 110 extending into the arc chute 105. Another embodiment features an arc runner 118 on the bottom arc plate 116. The preferred embodiment, features the top arc plate 110 and the bottom arc plate 116 each having an arc runner 112 and 118 respectively extending into the arc chute 105. The arc runner 112, 118 can be integral with the top arc plate 110 and the bottom arc plate 116. The arc plates 58 are fabricated from the ferro magnetic material, preferably steel with a nickel plating and the plates 58 are provided with mounting tabs 117. The intermediate arc plates 114 and the top arc plate 110 and bottom arc plate 116 are U-shaped as shown in FIGS. 8, 9 and 10.

Figure 11:
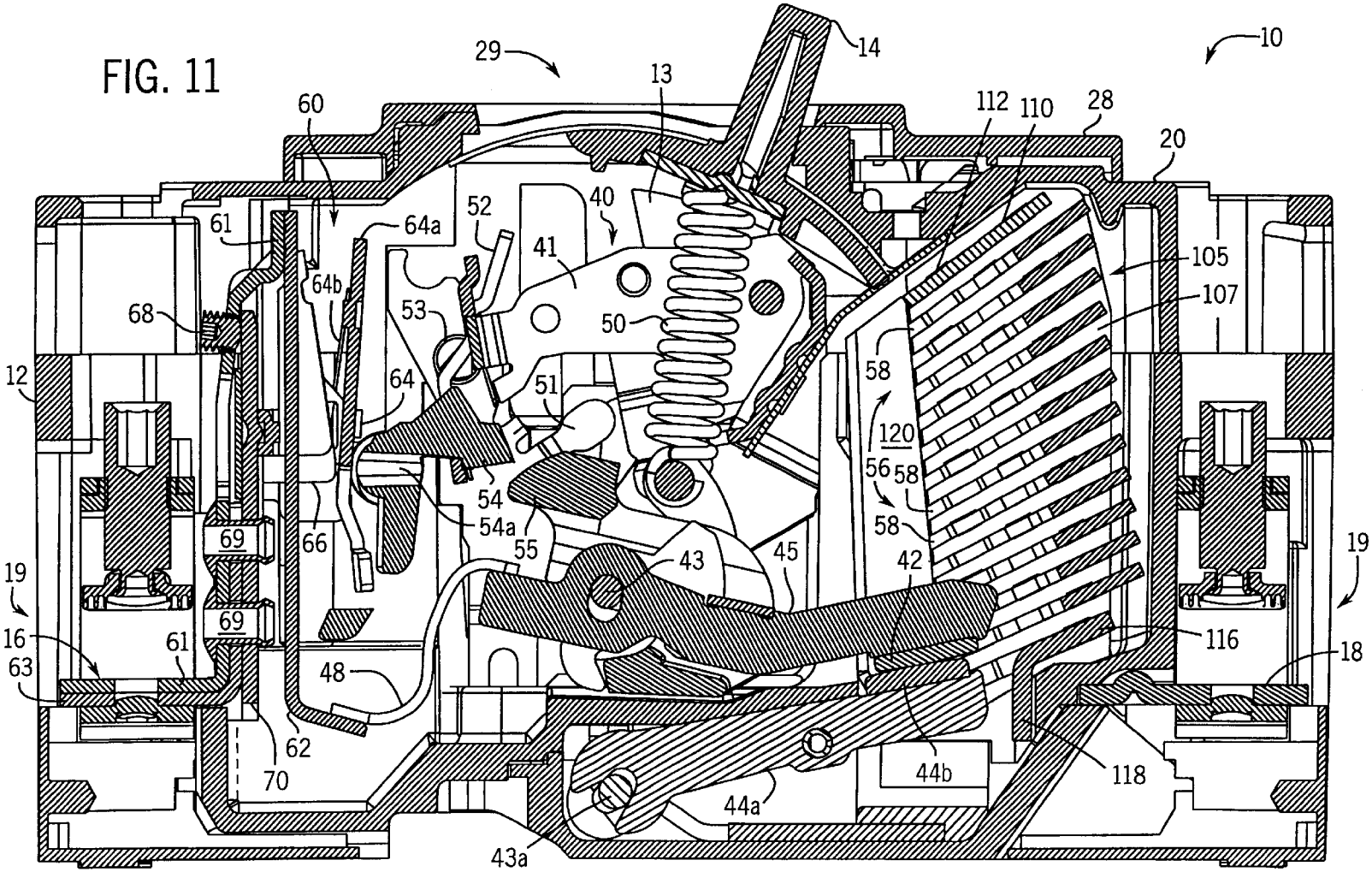
FIG. 11 is a section view of a circuit breaker illustrating the embodiment having a movable line contact and a movable load contact.

Each arc plate 58 is mounted to the sidewalls 106 and 107 by inserting the mounting tabs 117 into corresponding holes or slots formed or punched into the sidewalls. The arc plates 58 are arranged in a spaced apart stacked array preferably in a substantially parallel orientation at an angle with respect to the sidewalls 106, 107 other than zero. The angle facilitates the extension of the electrical arc in the arc chute 105 up and away from the line terminal 18 of the circuit breaker 10. Such orientation assists in preventing a terminal to terminal electrical connection formed by the hot ionized gasses expelled from the circuit breaker during its operation under load. The sidewall 106, 107 can be fabricated from any suitable insulating material having suitable strength to support the arc plates 58 and withstand the pressures and heat generated during the circuit breaker 10 operation. The arc chute assembly 105 is inserted into an arc chamber 56 formed in the housing 12 of the circuit breaker 10 for each pole. The contacts 42 and 44, see FIG. 2, and the contacts 42 and 44*b*, see FIG. 11 are positioned within the arc chamber 56 between the legs 111 of the arc plate 58.

In operation as the contacts 42, 44 of the circuit breaker 10 move apart the electrical arc is attracted to the arc runners 112, 118 due to the close vicinity of the contact arm 45 as the contact arm 45 moves through the arc chamber 56. In another embodiment, see Fig. 11, in addition to the moveable contact arm 45, the line contact 44*b* is also mounted on a moveable arm 44*a* which pivots about a movable line contact pivot 43*a*. As current flows from the line terminal 18 through the movable line contact arm 44*a* to the movable line contact 44*b* into the movable contact 42 and the movable contact arm 45, a repulsive magnetic force is generated between the two moveable contact arms 44*a*, and 45. The contacts, 42 and 44*b* are maintained in physical contact by the operating mechanism 40 of the circuit breaker 10, however, when the circuit breaker 10 is tripped by the trip mechanism 60 or manually by the handle 14, the operating mechanism 40 releases the respective moveable contact arms 45, 44*a* and the opposing magnetic forces assist to force the contact arms away from each other to break the electrical contact between the two contacts 42, 44*b*. The electrical arc generated during such operation is transferred to the bottom arc runner 118 and through and to the arc plates 58 as the moveable contact arm 45 moves up through the arc chute assembly 105 and the arc transfers to the arc runner 112 on the top arc plate 110. Such arrangement helps stretch the electrical arc over the entire length of the arc chamber 56 and involves all the arc plates 58 in the arc interruption. The arc runners 112, 118 attract the electrical arc to the ends of the contacts and contact arms and thus protect the critical surfaces of the contacts.

One embodiment of the electric arc extinguishing apparatus includes two end caps 120 with each end cap having an interior cavity 121 (see FIG. 7) with one leg 111 of each U-shaped arc plate 58 mounted in the cavity 121 of one end cap 120 and the other leg 111 of each U-shaped arc plate 58 mounted in the cavity 121 of the other end cap 120. See FIGS. 5 and 6. The end caps are formed from electrically insulating material which, during the presence of the electrical arc, ablates and outgasses material as a result of being exposed to the high heat from the electrical arc. The gasses produced assist in cooling the arc and increase the resistance of the conducting plasma generated within the arc chamber 56 which therefore, increases the arc voltage and accelerates the extinguishment of the electrical arc. The gasses generated also assist in blowing the electrical arc away from the contacts in the circuit breaker 10 embodiment having two movable contact arms 44*a*, 45 as shown in FIG. 11 and the embodiment having a movable contact arm 45 and a stationary contact bus 46 as shown in FIG. 2. The end caps 120 also prevent undesirable electrical arcing between the movable contact arm 45 and the intermediate arc plates 114 and other parts of the operating mechanism 40 of the circuit breaker 10.

While the embodiments illustrated in the Figures and described above are presently preferred, it should be understood that these embodiments are offered by way of example only. The invention is not intended to be limited to any particular embodiment, but it is intended to extend to various modifications that nevertheless fall within the scope of the intended claims. For example, other types of ferro magnetic material can be utilized for the arc plates and different shapes can be utilized for the arc plates. It is also contemplated that an electronic trip unit can be utilized. It is further contemplated that the trip mechanism having a bi-metal or electronic trip unit and load terminal be housed in a separate housing capable of mechanically and electrically connecting to another housing containing the operating mechanism and line terminal thereby providing for a quick and easy change of current ratings for an application of the circuit breaker contemplated herein. Other modifications will be evident of those with ordinary skill in the art.

What is claimed is:

1. An electric arc extinguishing apparatus for a molded case circuit breaker comprising:

a first side wall in a spaced relationship with a second sidewall;

a U-shaped top arc plate mounted between the first and second sidewall, and having an arc runner;

a plurality of U-shaped intermediate arc plates mounted in a spaced apart relationship from each other between the first and second sidewalls below and apart from the top arc plate;

a U-shaped bottom arc plate mounted between the first and second sidewalls below and apart from the intermediate plates, wherein the sidewalls and U-shaped plates form an arc chute with the arc runner extending between the legs of the U. Shaped plates of the arc chute and between the sidewalls; and two end caps with each end cap having an interior cavity, with one leg of each U-shaped arc plate removably received in the cavity of one end cap and the other leg of each U-shaped arc plate removably received in the cavity of the other end cap.

2. The electric arc extinguishing apparatus of claim 1, wherein the arc runner is integral with the top arc plate.

3. The electric arc extinguishing apparatus of claim 1, wherein the bottom arc plate has a second arc runner extending into the arc chute between the sidewalls.

4. The electric arc extinguishing apparatus of claim 3 wherein the second arc runner is integral with the bottom arc plate.

5. The electric arc extinguishing apparatus of claim 1, wherein the top arc plate and bottom arc plate each have an arc runner extending into the arc chute between the legs of the U-shaped top, bottom and intermediate plates and between the sidewalls.

6. The electric arc extinguishing apparatus of claim 1, wherein the arc plates are orientated at an angle other than zero with respect to the sidewalls.

7. A molded case circuit breaker comprising:

a molded case including a main cover;

a first terminal and a second terminal inserted in the case;

a first contact electrically coupled to the first terminal;

a second contact electrically coupled to the second terminal;

an operating mechanism having a pivoting member moveable between an ON position, an OFF Position and a TRIPPED position, wherein the pivoting member is coupled to the second contact;

an intermediate latching mechanism mounted in the housing and coupled to the operating mechanism;

a trip unit coupled to the second contact and the second terminal with the trip unit in selective operative contact with the intermediate latching mechanism; and, an electric arc extinguishing apparatus mounted in the housing and positioned in confronting relation with the first and second contact, the arc extinguishing apparatus comprising:

a first sidewall in a spaced relationship with a second side wall;

a U-shaped top arc plate mounted between the first and second sidewall and having an arc runner;

a plurality of U-shaped intermediate arc plates mounted in a spaced apart relationship from each other between the first and second sidewalls below and apart from the top arc plate;

a U-shaped bottom arc plate mounted between the first and second sidewalls below and apart from the intermediate plates, wherein the sidewalls and U-shaped plates form an arc chute along the path traveled by the contacts with the arc runner extending between the legs of the U-shaped plates of the arc chute and between the sidewalls; and, two end caps with each end cap having an interior cavity, with one leg of each U-shaped arc plate removably received in the cavity of one end cap and the other leg of each U-shaped arc plate received in the cavity of the other end cap.

8. The circuit breaker of claim 7, wherein the first contact is stationary and the second contact is movable.

9. The circuit breaker of claim 7, wherein the arc runner is integral with the top arc plate.

10. The circuit breaker of claim 7, wherein the bottom arc plate has a second arc runner extending into the arc chute between the sidewalls.

11. The circuit breaker of claim 10, wherein the second arc runner is integral with the bottom arc plate.

12. The circuit breaker of claim 7, wherein the top arc plate and bottom arc plate each have an arc runner extending into the arc chute between the legs of the U-shaped top, bottom, and intermediate plates and between the sidewalls.

13. The circuit breaker of claim 7, wherein the arc plates are orientated at an angle other than zero with respect to the sidewalls.

14. A circuit breaker comprising:

a molded housing including a base;

a means for connecting a load to the circuit breaker, mounted in the housing;

a means for connecting an electrical line to the circuit breaker mounted in the housing;

a means for coupling the means for connecting a load-electrically to the means for connecting an electrical line;

a movable means for contacting the means for connecting an electrical line to a means for operating mounted in the housing coupled with the means for operating having a pivoting member movable between an ON position, an OFF position, and a TRIPPED position, with the pivoting member coupled to the movable means for contacting and with the means for operating coupled to an intermediate means for latching the means for operating;

a means for tripping coupled to the movable means for contacting and the means for connecting a load with the intermediate means for latching, wherein the means for tripping includes a means for releasing under a short circuit condition and a means for releasing under an overload condition; and a means for extinguishing an electric arc mounted in the housing with the movable means for contacting extending into the means for extinguishing, wherein the means for extinguishing includes a plurality of U-shaped arc plates and two end caps with each end cap having an interior cavity, with one leg of each U-shaped arc plate removably received in the cavity of one end cap and the other leg of each U-shaped arc plate received in the cavity of the other end cap.

15. The circuit breaker of claim 14, including an arc runner on both a top arc plate and a bottom arc plate.

* * * * *